US005380106A

United States Patent [19]

West

[11] Patent Number: 5,380,106

[45] Date of Patent: Jan. 10, 1995

[54] SINGLE MOTOR SCANNING-HEAD PRINTER

[75] Inventor: William J. West, Los Altos, Calif.

[73] Assignee: Hewlett-Packard Company, Palo Alto, Calif.

[21] Appl. No.: 53,640

[22] Filed: Apr. 27, 1993

[51] Int. Cl.[6] ..... B41J 23/34

[52] U.S. Cl. ..... 400/185; 400/545; B41J/23/34

[58] Field of Search ..... 400/185, 184, 545, 562–564, 400/553, 572, 314, 313, 315, 547–547.7, 314.1, 573, 573.1, 636.2

[56] References Cited

U.S. PATENT DOCUMENTS

| | | | |
|---|---|---|---|
| 2,156,371 | 5/1939 | Buschmann | 400/573 |
| 4,257,282 | 3/1981 | Wilczewski et al. | 400/573 |
| 4,388,007 | 6/1983 | Meier et al. | 400/314 |
| 4,772,898 | 9/1988 | Noda | 400/185 |
| 4,958,949 | 9/1990 | Haftmann et al. | 400/545 |

FOREIGN PATENT DOCUMENTS

| | | | |
|---|---|---|---|
| 63-212571 | 9/1988 | Japan | 400/315 |

*Primary Examiner*—Edgar S. Burr
*Assistant Examiner*—Anthony H. Nguyen

[57] ABSTRACT

An apparatus for a scanning-head printer in which a single motor is used to provide movement to a print head carriage and to advance the paper along a paper path. The single motor is coupled to the print head carriage to provide movement of the carriage back and forth across the width of the paper. As the carriage is moved across the paper, the print head applies print to the paper. An advancement mechanism is located near the edge of the paper path. As the print head carriage reaches the edge of the paper, the carriage contacts the advancement mechanism which, in turn, causes the paper to be advanced along the paper path. Thus, a single motor advances the paper and moves the carriage across the paper.

12 Claims, 9 Drawing Sheets

SINGLE MOTOR SCANNING-HEAD PRINTER

TECHNICAL FIELD

The present invention relates generally to scanning-head printers, and more particularly to the movement of the print head and the advancement of the paper in scanning-head printers.

BACKGROUND ART

Scanning-head printers typically maintain a print head within a movable carriage. A paper drive is used to deliver paper to a position next to the carriage. The carriage is repeatedly moved back and forth, or "scanned", across the surface of the paper, with the print head applying print to the paper. After each pass of the carriage across the surface of the paper, the paper drive advances the paper to present a new region, or line, of the paper to the print head.

Conventional scanning-head printers use multiple motors to accomplish the printing process, since there is an inherent incompatibility of moving parts with respect to both the direction and timing of the movement. For example, a first motor provides a periodic, linear motion to the paper drive components for paper advancement, while a separate second motor is used to provide a substantially continuous, reciprocating motion to the carriage, with the reciprocating motion of the carriage being perpendicular to the direction of paper advancement.

The use of multiple motors achieves a cooperation of components for operating the printer, but increases the size, mass, and cost of the printer. Each motor requires electrical controls and gears to insure that the carriage or paper is moved an appropriate distance. These motors, controls, and gears add to the size, the mass, and the cost of the printer. Additionally, the housing of the printer must be sufficiently large to accommodate the above-mentioned components. Furthermore, because power must be supplied to multiple motors and electrical controls, power consumption is also increased in multiple motor scanning-head printers.

The drawbacks associated with scanning-head printers are especially problematic in the field of portable scanning-head printers, which ideally are in as compact a form as possible in order to enhance mobility with the size, it is desired to minimize the mass or weight of a portable printer. Multiple motors, electrical controls and gears, however, increase the size and weight of the printer.

Additionally, portable printers often function using finite power sources, such as batteries. Therefore, it is further desired to keep the power consumption of the printer at a minimum. The use of multiple motors and electrical controls, however, tends to quickly deplete limited power supplies.

Therefore it is an object of the present invention to provide a scanning-head printer having a smaller size and a lighter weight, which operates using less power, and which achieves these results at a reduced manufacturing cost. It is a further object of the present invention to provide a scanning-head printer which is compatible for use in portable printer applications.

SUMMARY OF THE INVENTION

The above object has been met by departing from conventional scanning-head printer designs to achieve a compact, lightweight, scanning-head printer which uses a single motor both to advance paper in a sequence of steps and to provide to-and-fro movement to a print head carriage along a path that is perpendicular to the paper advancement. This is accomplished by mechanically coupling the paper drive to an advancement mechanism which causes the paper drive to advance the paper after each pass of the motor driven print head carriage across the surface of the paper.

The advancement mechanism is placed on either or both sides of the paper such that the print head carriage contacts the advancement mechanism as the carriage reaches the edge of the paper. The advancement mechanism is coupled to the paper drive so that upon being contacted by the print head carriage, the advancement mechanism advances the paper. That is, the single motor drives the print head carriage and, in turn, the driven print head carriage drives the paper advancement. In so doing, the print head applies print to a new region or line on the paper upon each pass of the print head carriage across the surface of the paper.

In the preferred embodiment, the advancement mechanism is comprised of several components including a compressible hinge, a sliding block assembly, and a ratchet wheel- The hinge is coupled to the sliding block assembly. A tab located on the sliding block assembly is in contact with the ratchet wheel. The ratchet wheel is attached to a rail of the paper drive so that rotation of the ratchet wheel causes rotation of the paper drive rail, resulting in advancement of the paper. The movement of the carriage towards an end of carriage travel initiates the interaction of the components to advance the paper.

Specifically, as the carriage approaches the edge of the paper, a shaft located on the side of the carriage compresses the hinge which, in turn, causes movement of the sliding block assembly. The tab pushes against a tooth of the ratchet wheel, causing the wheel to rotate. Thus, with each compression of the hinge by the shaft on the carriage, the ratchet wheel is advanced, thereby causing rotation of the paper drive rail and advancement of the paper. As a result, during the next pass of the carriage across the paper, the printing head applies print to a new region or line on the paper.

By using only a single motor, the size and weight of the printer are reduced compared to previous scanning-head printers having multiple motors. Additionally, because only one motor is used, fewer electrical controls and gears are required, further reducing the size and weight of the printer. By eliminating one of the motors, the cost of the present invention is also reduced. Furthermore, by operating the scanning-head printer using a single motor, the power necessary to run the printer is reduced. That is, the scanning-head printer of the present invention has a reduced size, weight, and cost, with a simultaneous decrease in the power consumption rate of the printer.

BEST MODE FOR CARRYING OUT THE INVENTION

Figure 1:
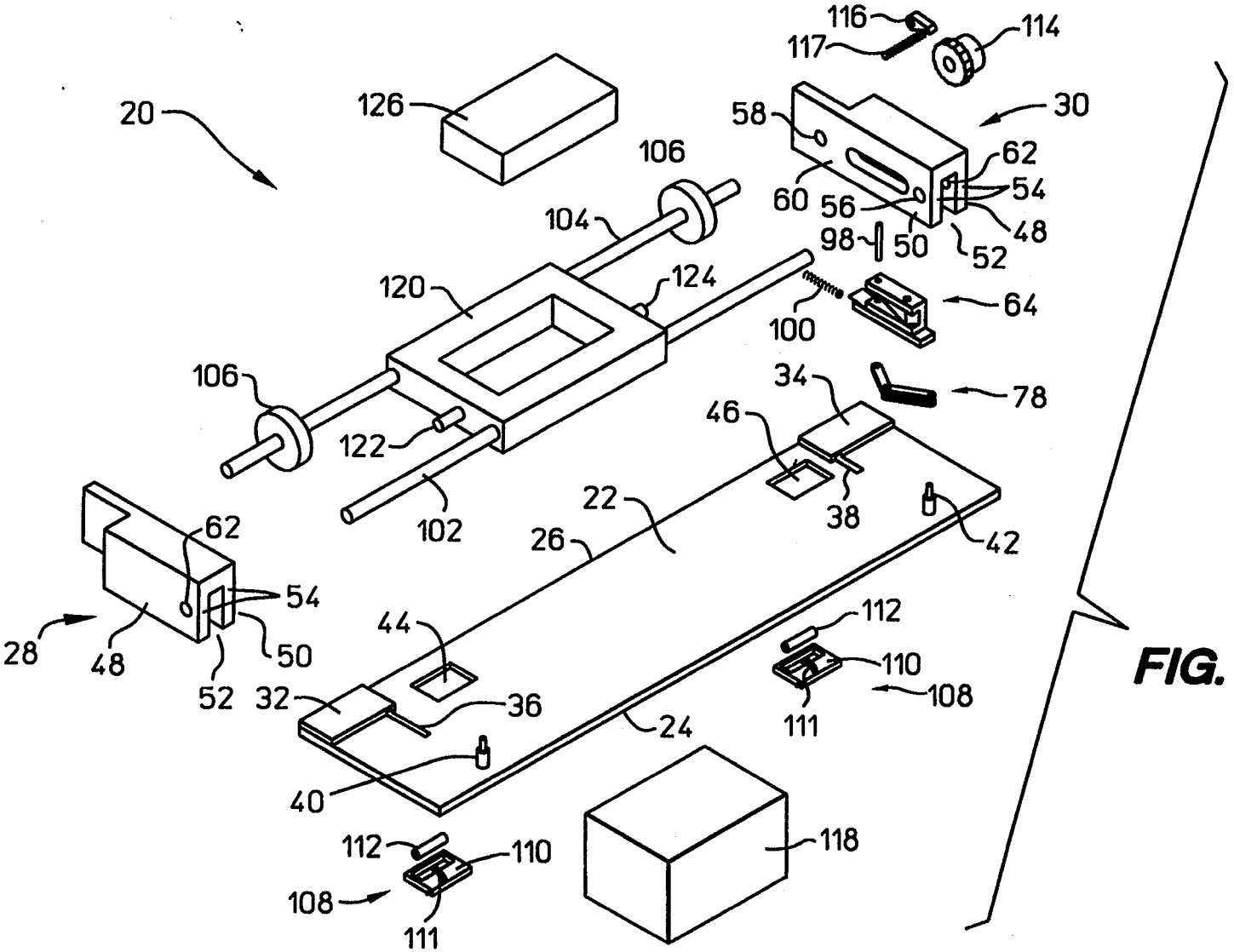
FIG. 1 is an exploded perspective view of the components of a scanning-head printer in accordance with the present invention.

With reference to FIG. 1, an exploded perspective view of the scanning-head printer 20 of the present invention is shown. The housing, in which scanning-head printer 20 resides, is not shown in order to more clearly illustrate the details of scanning-head printer 20. The following description of the present invention will begin with a detailed description setting forth the mechanical structure of scanning-head printer 20. This description will then be followed by a detailed description setting forth the operation of the present invention.

The main frame of printer 20 is formed of a base plate 22, having a front edge 24, a rear edge 26, and two bearing blocks 28 and 30. Rectangular plates 32 and 34 are attached to the rear corner regions of base plate 22. Grooves 36 and 38 are also formed into base plate 22. Grooves 36 and 38 extend in a lengthwise direction from slightly in front of rectangular plates 32 and 34 towards front edge 24 of base plate 22. Cylindrical posts 40 and 42, having bases with a diameter which is larger than the diameter of the tops of the posts, are arranged near front edge 24 of base plate 22. The posts 40 and 42 are arranged in front of grooves 36 and 38, respectively, with posts 40 and 42 residing between front edge 24 and grooves 36 and 38. Rectangular openings 44 and 46 are formed through base plate 22 near rear edge 26 and between rectangular plates 32 and 34.

Bearing blocks 28 and 30 each have opposing sidewalls 48 and 50 defining a cavity 52 therebetween. Cavity 52 extends from the bottom to near the top surface of bearing blocks 28 and 30. Sidewall 50 has a greater length than sidewall 48, so that while the front surface 54 of sidewalls 48 and 50 reside in the same plane, the back surface of sidewall 48 is recessed relative to the back surface of sidewall 50. Therefore, bearing blocks 28 and 30 are formed having a recessed portion along the back surface thereof. Circular openings 56 and 58, and an oval opening 60 are formed into sidewall 50 of bearing blocks 28 and 30. Another circular opening 62 having the same size as opening 56 extends through sidewall 48, with openings 56 and 62 aligned with each other.

Figure 2:
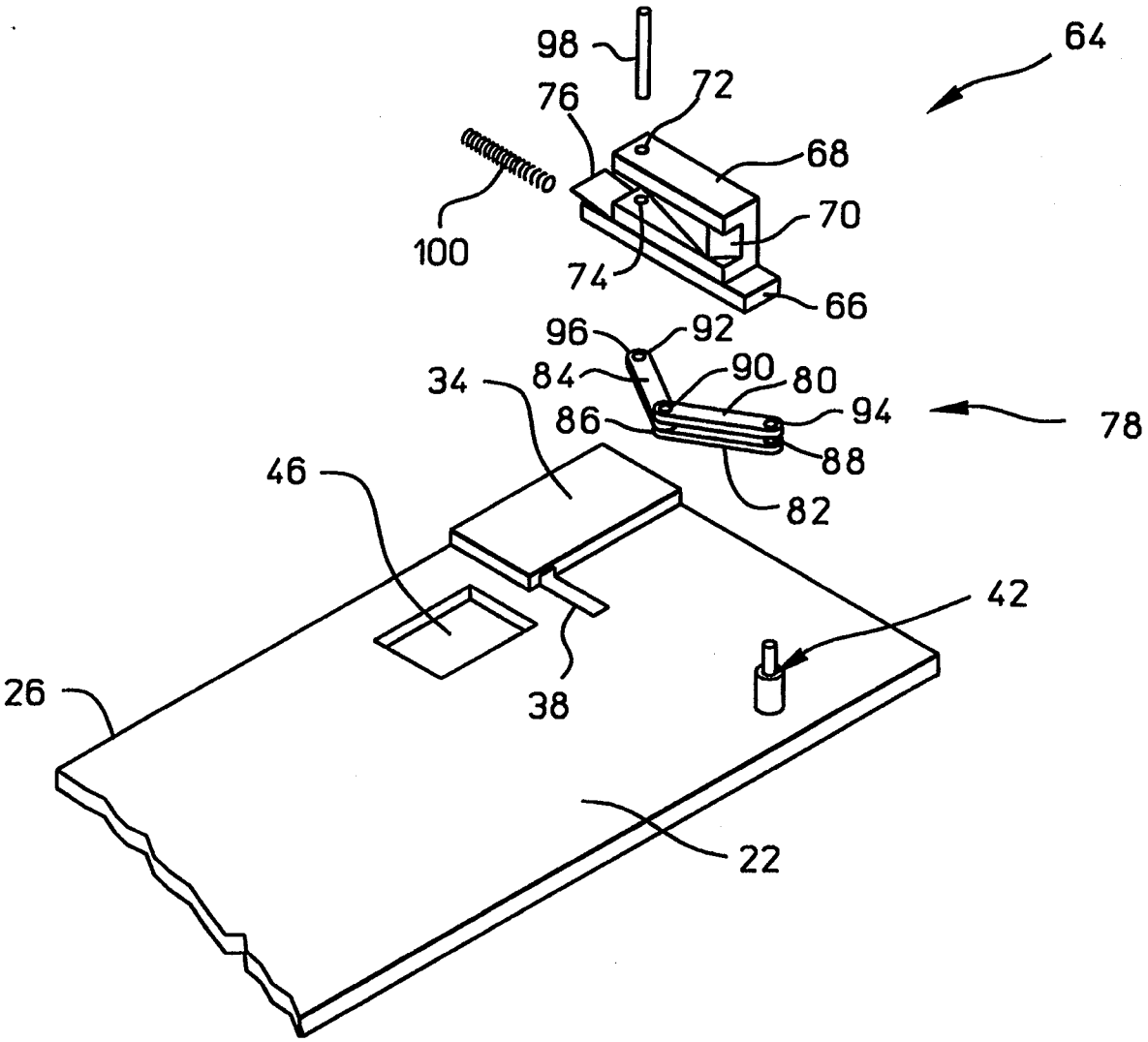
FIG. 2 is an exploded perspective view of the sliding block assembly, hinge assembly, and portion of the base plate of FIG. 1 before assembly in accordance with the present invention.

Referring now to FIG. 2, an exploded perspective view highlighting a sliding block assembly 64 of FIG. 1 is shown. Sliding block assembly 64 is movably mounted on base plate 22 between cylindrical post 42 and rectangular plate 34. A base 66 of sliding block assembly 64 has a top region 68 attached thereto. The width of base 66 is just slightly less than the width of cavity 52 of bearing blocks 28 and 30. The base includes a recession 70 into one side of top region 68 and includes an opening 72 through the top surface of top region 68. A corresponding opening 74 is formed in the bottom surface of top region 68. A tab 76 is disposed between base 66 and top region 68 so that tab 76 extends beyond the edge of base 66.

Figure 3:
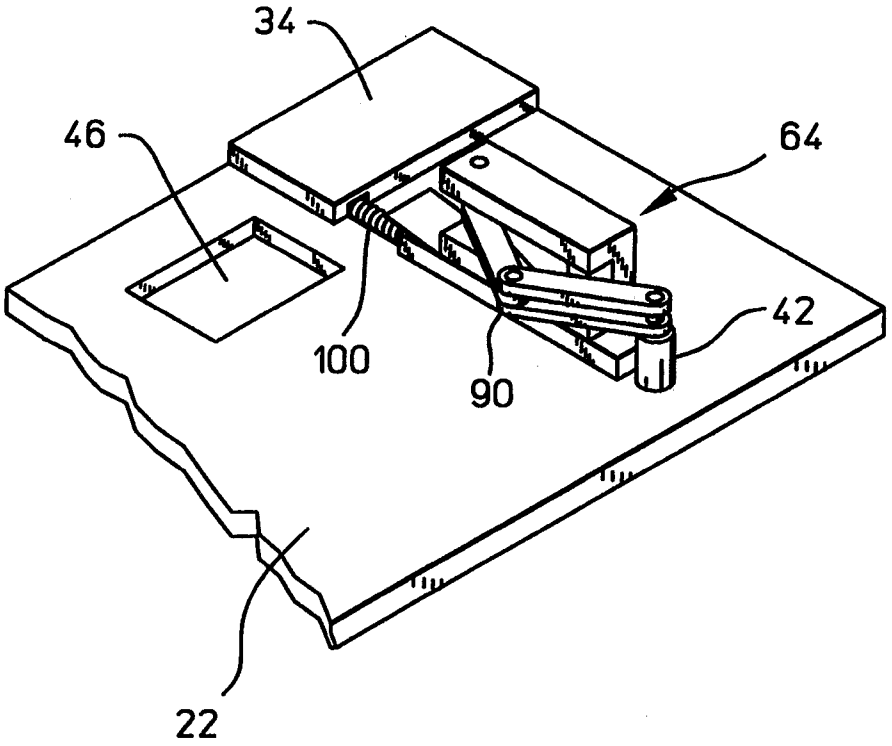
FIG. 3 is a perspective view of the sliding block assembly, hinge assembly, and portion of the base plate as shown in FIG. 2 after assembly in accordance with the present invention.

A three bar hinge assembly 78 comprised of two parallel bars 80 and 82 disposed around one end 86 of a third bar 84 is shown in FIGS. 2 and 3. Parallel bars 80 and 82 are attached at joint 90. End 86 of bar 84 is rotatably fixed at joint 90 between bars 80 and 82 such that the other end 92 of bar 84 can revolve about joint 90. Openings 94 and 96 are formed through bars 80 and 82 at end 88, and through bar 84 at end 92, respectively. Opening 94 is placed over the top of cylindrical post 42 resulting in bar 80 being supported by the base of post 42. The top of post 42 extends through opening 94 in bars 80 and 82, while still allowing rotation of bars 80 and 82 about post 42.

Next, sliding block assembly 64 is positioned on base plate 22 between rectangular plate 34 and cylindrical post 42. Hinge assembly 78 is then coupled to sliding block assembly 64 by placing end 92 of hinge assembly 78 into recession 70 of top region 68 so that opening 96 is aligned with openings 72 and 74 of top region 68. An axle pin 98 is then inserted through openings 72, 74, and 96, rotatably joining end 92 of bar 84 to top region 68 of sliding block assembly 64. A helical spring 100 is placed into groove 38 with one end contacting rectangular plate 34 and the other end contacting base 66 of sliding block assembly 64.

As shown in FIG. 3, the sliding block assembly 64 is confined on one side by spring 100 and rectangular plate 34, and confined on the other side by post 42. Thus, sliding block assembly 64 is movable between rectangular plate 34 and cylindrical post 42. Additionally, hinge assembly 78 conforms to the shape of recession 70 in top region 68 of sliding block assembly 64. As a result, joint 90 of hinge assembly 78 extends towards the center of base plate 22. Although only a single sliding block and hinge assembly is used in the preferred embodiment of the present invention, optionally, a second sliding block and hinge assembly can be placed on base plate 22 for movement between rectangular plate 32 and cylindrical post 40 of FIG. 1.

Figure 4:
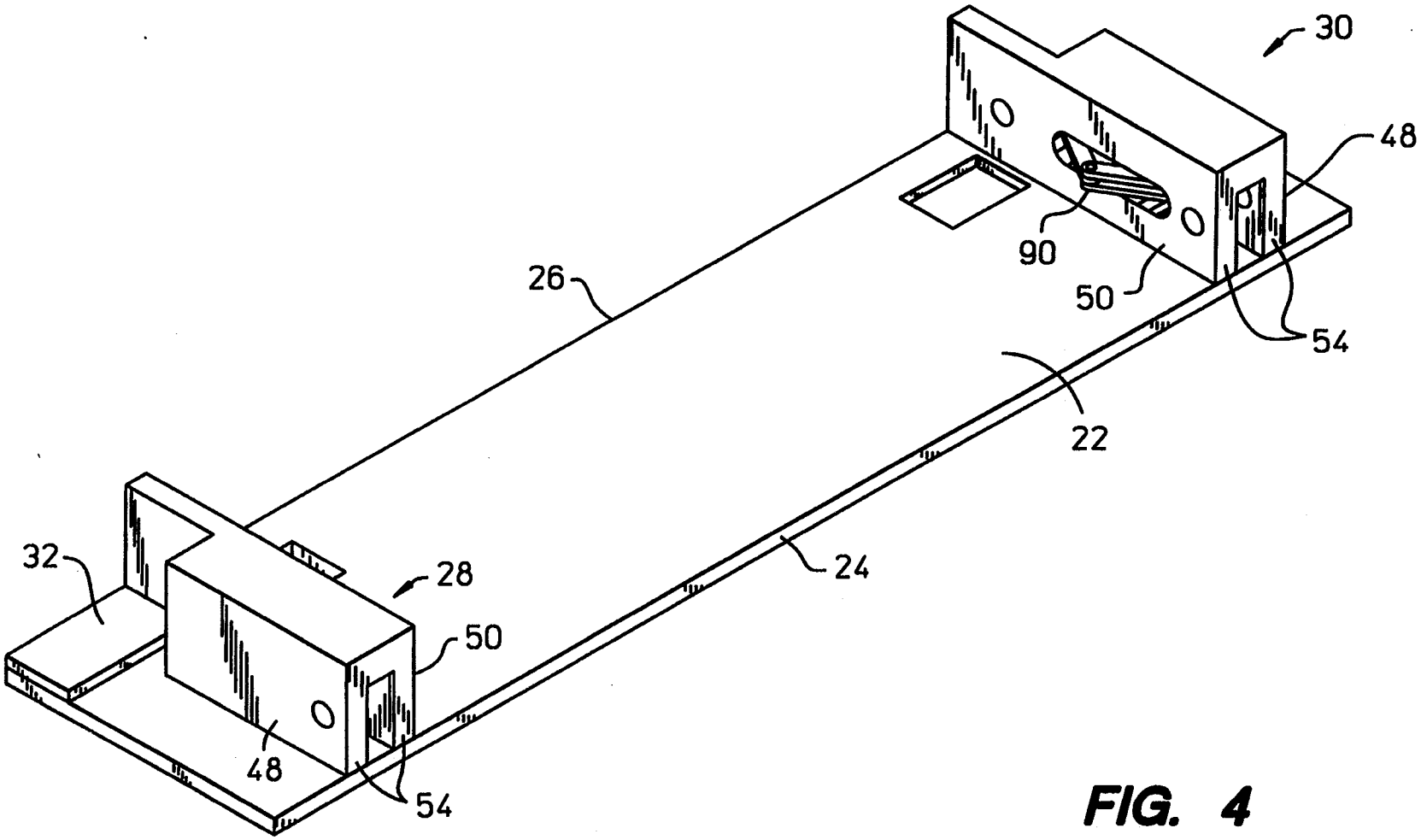
FIG. 4 is a perspective view showing a step in the formation of a scanning-head printer in accordance with the present invention.

Referring now to FIGS. 2–4, but particularly FIG. 4, bearing blocks 28 and 30 are attached to base plate 22 with sidewalls 50 aligned parallel to and facing each other and spaced approximately a paper width apart. Front surfaces 54 of sidewalls 48 and 50 are arranged flush with front edge 24 of base plate 22. The rear surface of sidewall 50 is arranged flush with rear edge 26 of base plate 22. Also, the rear portion of sidewall 48 of bearing blocks 28 and 30 is disposed in front of rectangular plates 32 and 34, respectively, so that rectangular plates 32 and 34 reside within the recessed portion of bearing blocks 28 and 30.

Furthermore, bearing block 30 is positioned having cylindrical post 42, spring 100, and sliding block assembly 64, residing within cavity 52. Joint 90 of hinge assembly 78 extends through oval opening 60 and into the area between sidewalls 50. As a result, sliding block assembly 64 is confined in a widthwise direction by sidewalls 48 and 50, and in a lengthwise direction by spring 100 and rectangular plate 34, and by post 42.

Figure 5:
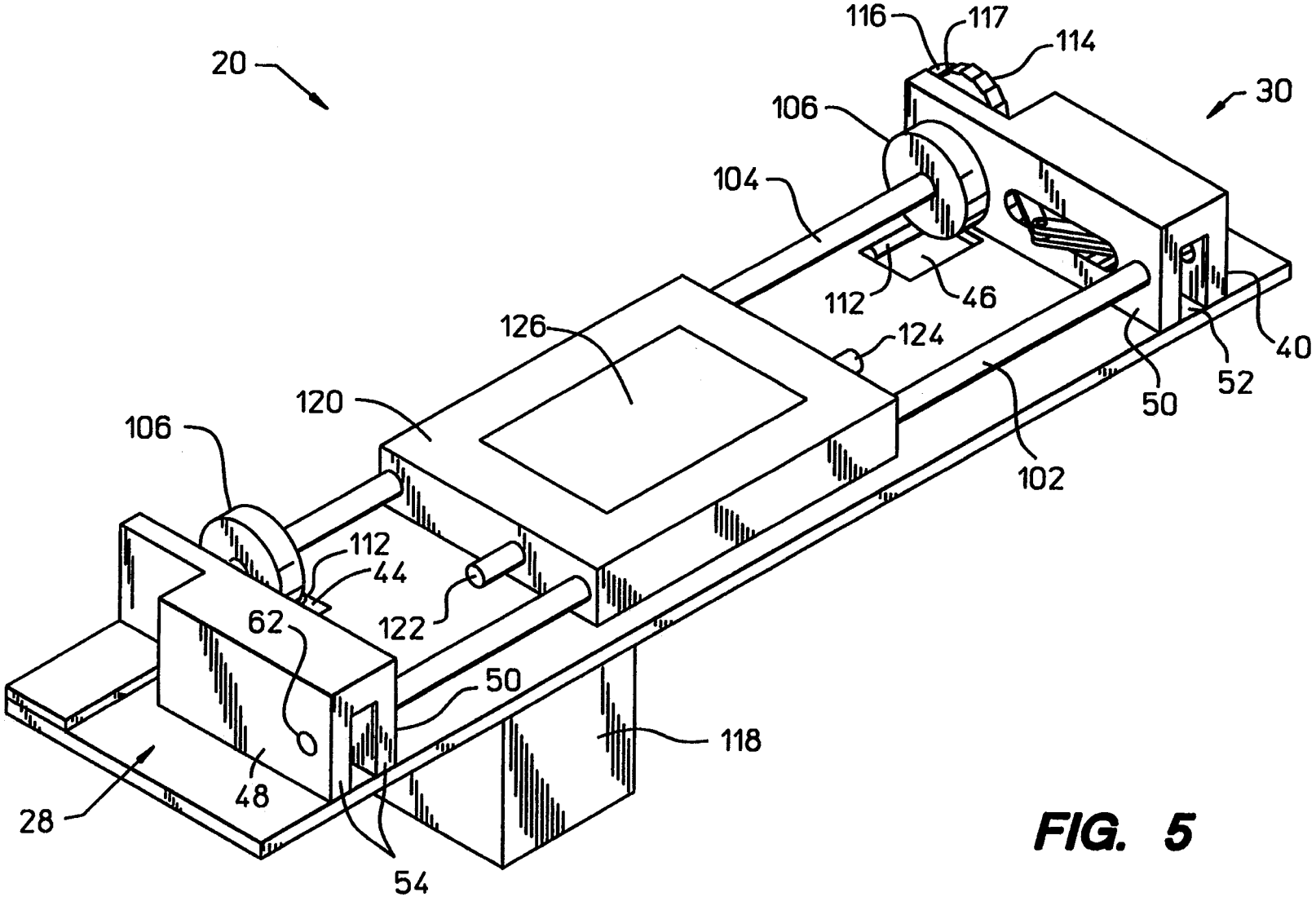
FIG. 5 is a perspective view showing a step in the formation of a scanning-head printer in accordance with the present invention.

With reference now to FIGS. 1 and 5, a rail 102 is inserted through openings 56 and 62 of sidewalls 50, with rail 102 disposed between bearing blocks 28 and 30. A paper drive rail 104 is inserted through openings 58 of sidewalls 50, with rail 104 disposed between bearing blocks 28 and 30, and parallel to rail 102. Unlike rail 102, however, paper drive rail 104 is rotatably fixed between bearing blocks 28 and 30, to allow rotation of paper drive rail 104. Paper drive wheels 106 are arranged along paper drive rail 104 directly over the openings 44 and 46 in base plate 22. Paper drive wheels 106 are fixed to paper drive rail 104 so that drive wheels 106 rotate when paper drive rail 104 is rotated.

Pinch roller assemblies are mounted directly under paper drive wheels 106, underneath base plate 22. As shown in FIG. 1, pinch roller assemblies 108 consist of a frame 110, a leaflet spring 111, and a roller 112 which is mounted in frame 110. Referring again to FIG. 5, rollers 112 are in contact with paper drive wheels 106 through openings 44 and 46. Rollers 112 are pressed upwardly against paper drive wheels 106 by leaflet spring 111 to insure that paper disposed between rollers 112 and drive wheels 106 is firmly retained therebetween. A paper supply tray, not shown, holds a quantity of paper in close proximity to rollers 112 and drive wheels 106. The supply tray provides paper as needed to scanning-head printer 20. Paper drive wheels 106 are rubber coated to provide a surface that will prevent slippage of wheels 106 on the surface of a sheet of paper. Although the drive wheels in the preferred embodiment of the present invention are rubber coated, any of the numerous "non-slip" materials well known in the art would be suitable.

Figure 8:
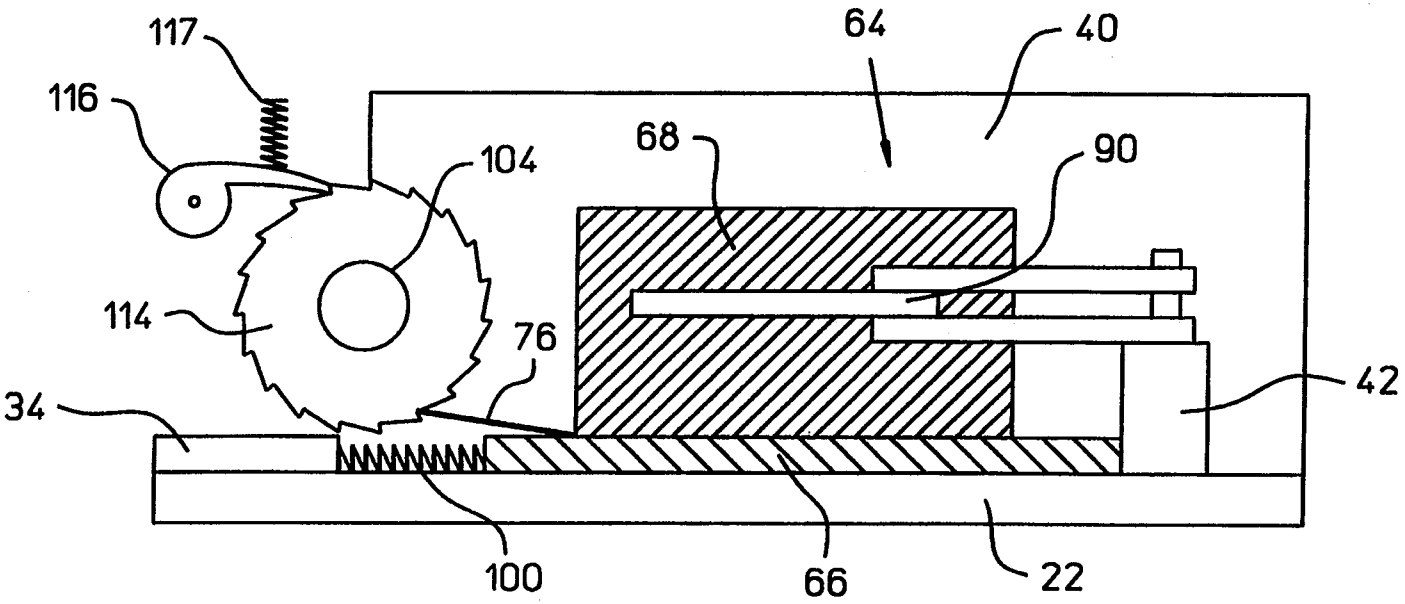
FIG. 8 is a cut-away view of the advancement mechanism of a scanning-head printer taken along line A—A of FIG. 6 in accordance with the present invention.

A ratchet wheel 114 is attached to one end of paper drive rail 104. Ratchet wheel 114 is arranged with the toothed portion of ratchet wheel 114 situated next to cavity 52 of bearing block 30. Ratchet wheel 114 is fixed to paper drive rail 104 with rotation of ratchet wheel 114 resulting in rotation of paper drive rail 104. Referring briefly to FIGS. 5 and 8, a spring lever 116 is mounted on sidewall 50 of bearing block 30 directly above ratchet wheel 114. Spring lever 116 has one end pressed downwardly against ratchet wheel 114 by a leaflet spring 117. Although the other end of leaflet spring 117 is attached to bearing block 30 in the preferred embodiment of the present invention, alternate arrangements of leaflet spring 117 will be obvious to one of ordinary skill in the art. As a result, spring lever 116 resiliently contacts ratchet wheel 114, thereby insuring that ratchet wheel 114 is only able to rotate in one direction.

Returning to FIGS. 1 and 5, carriage 120 is slidably mounted on rails 102 and 104 for movement along rails 102 and 104 between bearing blocks 28 and 30. A single motor 118 is coupled to carriage 120 to provide movement of carriage 120 between bearing blocks 28 and 30. In the preferred embodiment of the present invention, single motor 118 is a conventional stepping motor, although any of the numerous motors well known in the art would be suitable. Shafts 122 and 124 are attached to the side of carriage 120. Shaft 124 is located on carriage 120 so that it will contact joint 90 of hinge assembly 78 as carriage 120 is moved as far as possible towards bearing block 30. Carriage 120 retains a printing head 126 therein. Thus, as carriage 120 is moved between bearing blocks 28 and 30, printing head 126 is also moved between bearing blocks 28 and 30.

IN OPERATION

Figure 6:
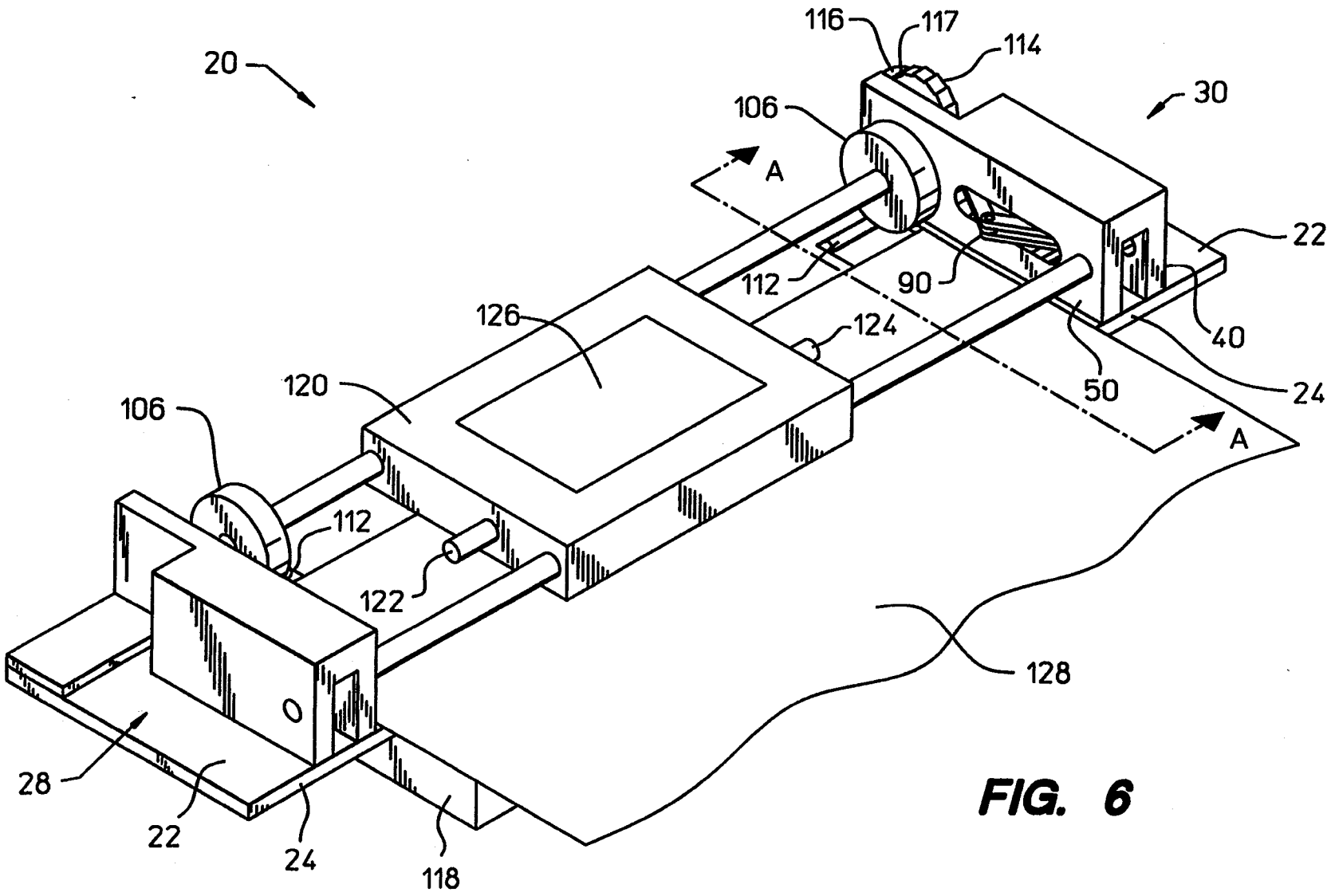
FIG. 6 is a perspective view showing a scanning-head printer with a sheet of paper disposed therein in accordance with the present invention.
Figure 7A:
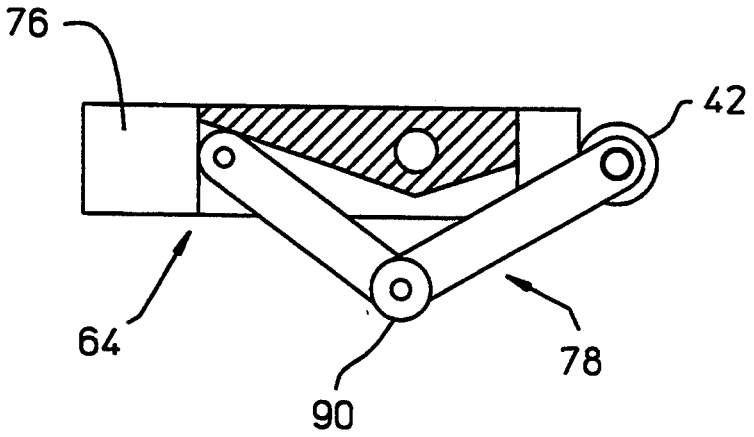
FIGS. 7*a* and 7*b* are top views showing the range of movement of a hinge and sliding block assembly in accordance with the present invention.
Figure 7B:
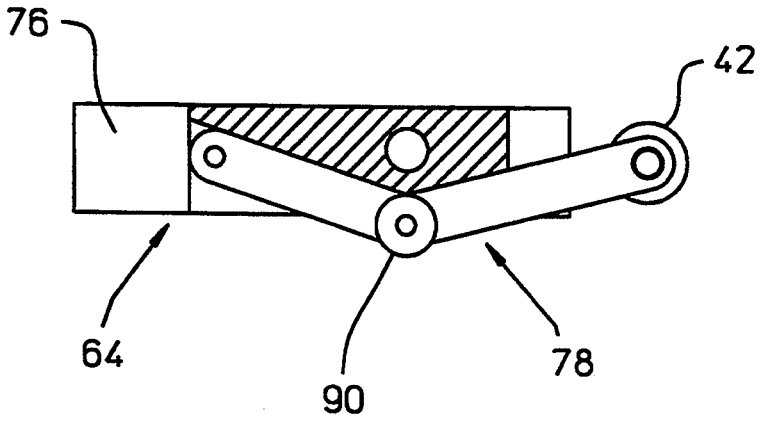

With reference now to FIGS. 3 and 6, a detailed description of the operation of the present invention is given. To prepare scanning-head printer 20 for printing, a sheet of paper 128 is introduced along front edge 24 of printer 20. A paper tray, not shown, supplies the paper 128 as needed. Paper 128 is inserted between carriage 120 and base plate 22 until the paper 128 is disposed between paper drive wheels 106 and pinch rollers 112.

Single motor 118 is coupled to carriage 120. Although the coupling means are not shown, single motor 118 could be coupled to carriage 120, using a timing belt or any of the numerous coupling methods well known in the art. Single motor 118 provides reciprocating movement to carriage 120 between bearing blocks 28 and 30. As carriage 120 moves from bearing block 30 towards bearing block 28, printing head 126 applies print to paper 128.

After each pass of carriage 120 from bearing block 30 to bearing block 28, carriage 120 returns to a position next to bearing block 30. As carriage 120 closely approaches bearing block 30, shaft 124 of carriage 120 contacts joint 90 of hinge assembly 78. Shaft 124 presses joint 90 towards sidewall 48 of bearing block 30. The force applied at joint 90 causes sliding block assembly 64 to move in a rearward direction towards ratchet wheel 114.

The movement of sliding block assembly 64, caused by the contact of shaft 124 at joint 90, is illustrated in FIGS. *7a* and *7b*. FIG. *7a* is a top view of sliding block assembly 64 and hinge assembly 78, with joint 90 extended away from sliding block assembly 64. FIG. *7b* is a top view with joint 90 pressed towards sliding block assembly 64. Because hinge assembly 78 is attached to post 42, compression of joint 90 results in movement of sliding block assembly away from post 42. That is, sliding block assembly 64 moves away from post 42 and towards the rear edge of the base plate, not shown. Furthermore, the sidewalls of the bearing block, not shown, confine sliding block assembly 64 to motion either towards or away from the rear edge of the base plate.

FIG. 8, taken along line A—A of FIG. 6, with sidewall 50 of bearing block 30 removed, shows in detail the interaction between sliding block assembly 64 and ratchet wheel 114. Tab 76 of sliding block assembly 64 contacts a tooth of ratchet wheel 114. As joint 90 is pressed by the shaft of the carriage, not shown, base 66, top region 68, and tab 76 are moved towards ratchet wheel 114. As a result, tab 76 pushes against the tooth of ratchet wheel 114, causing the wheel 114 to rotate. Rectangular plate 34 and spring 100 limit the movement of sliding block assembly 64 towards ratchet wheel 114. Specifically, the movement of sliding block assembly 64 is limited to insure that tab 76 causes ratchet wheel 114 to rotate, or advance, by a distance of only one tooth. Although rotation of ratchet wheel 114 in the present invention corresponds to movement of the paper by approximately one standard line space, it will be understood that the amount of rotation imparted to ratchet wheel 114 may be varied by altering dimensions of the components of the present invention.

After the carriage and shaft, not shown, move away from joint 90, spring 100 pushes sliding block assembly 64 back to its original position. As a result, joint 90 is again fully extended through the opening in the sidewall, not shown. Spring lever 116, having one end resiliently mounted against ratchet wheel 114 by leaflet spring 117, prevents rotation of ratchet wheel 114 in the opposite direction as sliding block assembly 64 returns to its original position. Thus, with each contact of joint 90 by the shaft of the carriage, ratchet wheel 114 is advanced by one tooth so as to rotate paper drive rail 104 and the paper drive rollers, not shown, resulting in advancement of the paper.

With reference again to FIG. 6, carriage 120 is driven by single motor 118 between bearing blocks 28 and 30, with printing head 126 applying print to paper 128 during movement of carriage 120 from bearing block 30 to bearing block 28. Upon the return of carriage 120 to a position next to bearing block 30, shaft 124 presses joint 90, resulting in rotation of ratchet wheel 114 and, consequently, forward movement of paper 128. Specifically, as carriage 120 passes from bearing block 30 to bearing block 28, printing head 126 applies print to paper 128. Carriage 120 then returns from bearing block 28 to bearing block 30, during which time printing head 126 does not apply print to paper 128. As carriage 120 closely approaches bearing block 30, shaft 124 presses joint 90, thereby causing advancement of paper 128. As a result, during the next pass of carriage 120 from bearing block 30 to bearing block 28, printing head 126 applies print to a new region or line of paper 128.

Using only a single motor 118 to advance the carriage 120 and cause advancement of the paper 128 has several advantages. Because only one motor is needed, the manufacturing costs associated with having additional motors, and electrical gears and controls necessary to operate the additional motors, are eliminated. Using only a single motor and fewer gears and controls allows the scanning-head printer of the present invention to be built in a more compact form and with a lighter weight than was possible in prior scanning-head printers. Additionally, operating the scanning-head printer of the present invention using only a single motor reduces the power consumption compared to previous printers which use multiple motors. Furthermore, because all of these advantages enhance the mobility of the scanning-head printer, the present invention is particularly well suited for use in portable printer applications.

Figure 9:
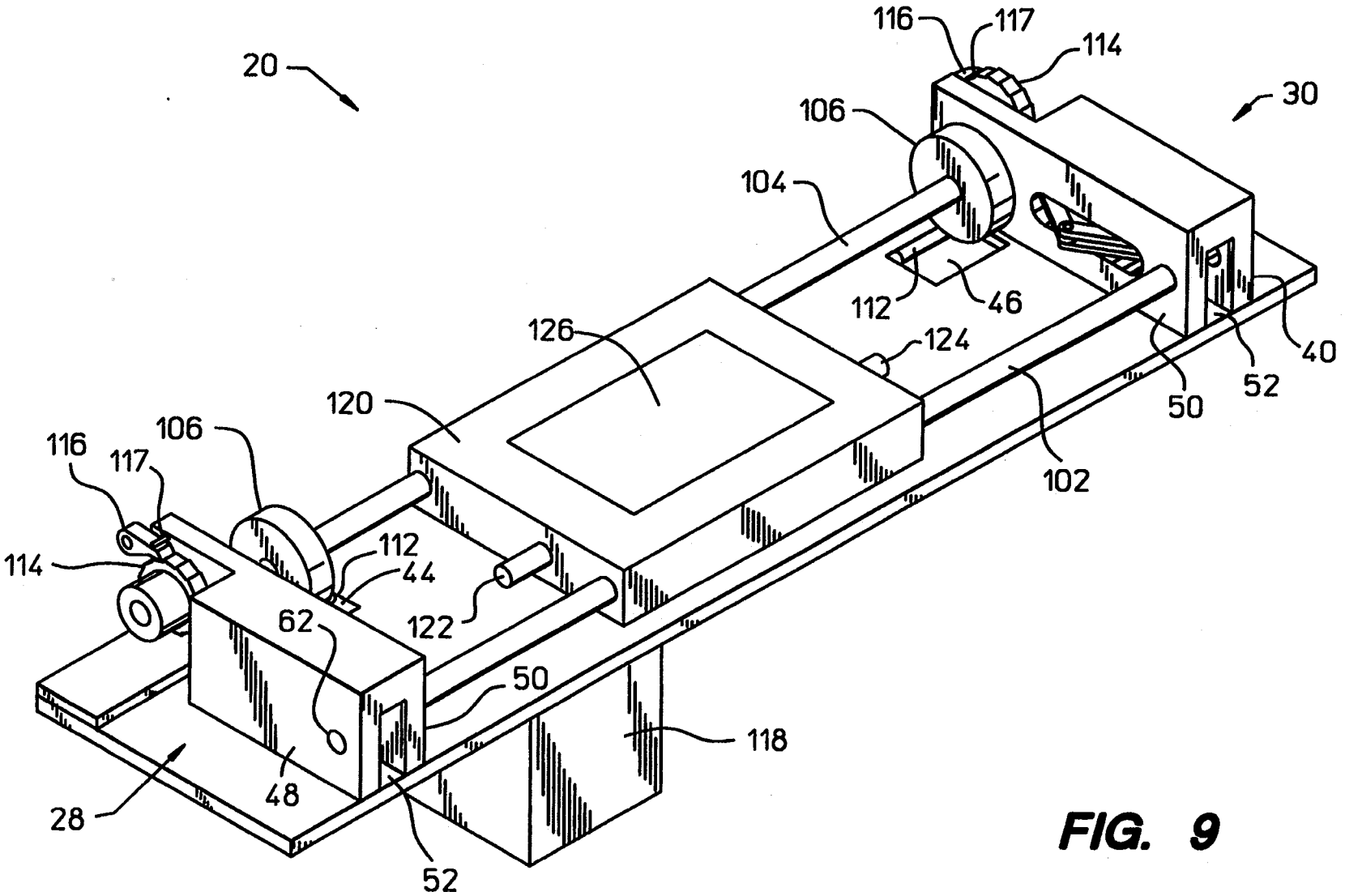
FIG. 9 is a perspective view showing an alternate embodiment of a scanning-head printer in accordance with the present invention.

Although the printing head in the preferred embodiment of the present invention only applies print to the paper when the print head is moving in one direction across the page, the methods of the present invention are also well suited to print heads which apply print when traveling in both directions across the page. As shown in FIG. 9, in such systems both bearing blocks 28 and 30 have a sliding block assembly and an accompanying hinge assembly contained therein. Additionally, ratchet wheels 114 must be affixed to both ends of paper drive rail 104, and shafts 122 and 124 must be present on both sides of carriage 120. Consequently, each time carriage 120 approaches either of bearing blocks 28 or 30, ratchet wheel 114 is rotated and the paper is advanced. As a result, print head 126 applies print to a new region or line of the paper during each pass, in either direction, across the paper.

Referring again to FIG. 6, the present invention is also suitable for requirements, such as double spacing or spacing between paragraphs, where the advancement of paper 128 is desired without the need for printing. In such cases, carriage 120 moves slightly away from bearing block 30 and then back towards bearing block 30 to press joint 90 as many times as is necessary to advance paper 128 the desired distance.

Thus, the present invention provides a scanning-head printer which uses only a single motor, has a smaller size and a lighter weight, operates using less power, and achieves these results at a reduced manufacturing cost.

I claim:

1. A scanning-head printer comprising:

frame means for defining a paper path;

a motor supported by said frame means;

a carriage connected to said frame means for reciprocating motion along a carriage path having first and second extreme positions, said carriage path being generally perpendicular to said paper path, said motor being connected to said carriage to selectively drive said carriage along said carriage path;

print means fixed to said carriage for applying print to paper positioned on said paper path; and a paper advancement assembly, supported on said frame means, for advancing said paper positioned along said paper path when said carriage reaches said first extreme position, said paper advancement assembly including (a) an extensible pivoting hinge pivotable between a retracted condition and an extended condition, said extensible pivoting hinge being disposed such that movement of said carriage into said first extreme position elongates said extensible pivoting hinge, (b) a sliding member secured to said extensible pivoting hinge to be linearly displaced upon pivoting of said extensible pivoting hinge, and (c) means for advancing said paper along said paper path in response to displacement of said sliding member.

2. The printer of claim 1 wherein said extensible pivoting hinge has a first end in fixed position relative to said frame means and has a second end fixed to said sliding member, said extensible pivoting hinge having a pivot axis positioned between said first and second ends, said extensible pivoting hinge having an intermediate region extending into said carriage path when said extensible pivoting hinge is in said retracted condition, wherein movement of said carriage into said first extreme position causes said carriage to press said intermediate region into said extended condition.

3. The printer of claim 2 wherein said extensible pivoting hinge includes bars connected together at said pivot axis.

4. The printer of claim 3 wherein said carriage includes a projecting member positioned to contact at least one of said bars when said carriage reaches said first extreme position.

5. The printer of claim 1 wherein said means for advancing includes a ratchet wheel and a paper drive member, said ratchet wheel being operatively associated with said sliding member for rotation in response to displacement of said sliding member, said paper drive member being rotatably driven by said ratchet wheel.

6. The printer of claim 5 wherein said ratchet wheel and said sliding member are connected by a tab secured to said sliding member, said tab being coupled to said ratchet wheel such that extension of said extensible pivoting hinge into said extended condition causes rotation of said ratchet wheel.

7. The printer of claim 1 further comprising means for biasing said extensible pivoting member into said retracted condition.

8. The printer of claim 1 further comprising a second paper advancement assembly supported on said frame means for advancing said paper along said paper path when said carriage reaches said second extreme position, said second paper advancement assembly including a second extensible pivoting hinge and a second sliding member.

9. A scanning head printer comprising:

a paper feed path;

a carriage movable in a direction perpendicular to said paper feed path between a first edge and a second edge of carriage travel;

a printhead connected to said carriage for travel therewith;

a motor connected to drive said carriage;

a hinge having a fixed first end and a linearly displaceable second end, said hinge having a pivot axis between said first and second ends, said hinge having a rest position in which said hinge extends into a path of said carriage at said first edge such that movement of said carriage at said first edge causes said hinge to pivot at said pivot axis and to displace said second end linearly;

a slidable member connected to said second end of said hinge for displacement therewith; and means for advancing paper on said paper feed path in response to displacement of said slidable member.

10. The printer of claim 9 wherein said hinge includes a plurality of bars connected at said pivot axis.

11. The printer of claim 9 wherein said means for advancing includes a ratchet wheel operatively associated with said slidable member to be rotated upon displacement of said slidable member.

12. The printer of claim 9 further comprising stop structure for limiting the extent of pivot of said hinge.

* * * * *